United States Patent [19]

Eridon et al.

[11] Patent Number: 4,743,312

[45] Date of Patent: May 10, 1988

[54] METHOD FOR PREVENTING RECRYSTALLIZATION DURING HOT ISOSTATIC PRESSING

[75] Inventors: John M. Eridon, Whitehall; Ranes P. Dalal, N. Muskegon, both of Mich.

[73] Assignee: Howmet Corporation, Greenwich, Conn.

[21] Appl. No.: 39,683

[22] Filed: Apr. 20, 1987

[51] Int. Cl.[4] ..... C21D 1/78

[52] U.S. Cl. ..... 148/131; 148/11.5 N; 148/2; 148/3; 148/428; 419/49; 419/68

[58] Field of Search ..... 148/421, 131, 133, 2, 148/3, 11.5 N, 428; 419/49, 68

[56] References Cited

U.S. PATENT DOCUMENTS

| | | | |
|---|---|---|---|
| 3,279,917 | 10/1966 | Ballard et al. | 75/226 |
| 3,773,506 | 11/1973 | Larker et al. | 75/226 |
| 4,171,562 | 10/1979 | Freeman et al. | 29/530 |
| 4,446,100 | 5/1984 | Adlerborn et al. | 419/48 |
| 4,448,747 | 5/1984 | Moritoki et al. | 419/49 |
| 4,478,789 | 10/1984 | Adlerborn et al. | 419/49 |
| 4,482,398 | 11/1984 | Eylon et al. | 148/421 |
| 4,505,764 | 3/1985 | Smickley et al. | 148/421 |
| 4,612,066 | 9/1986 | Levin et al. | 148/133 |
| 4,624,714 | 11/1986 | Smickley et al. | 148/421 |

OTHER PUBLICATIONS

Metals Handbook, Ninth Edition, "vol. 7: Powder Metallurgy," American Society for Metals, pp. 436–438.

*Primary Examiner*—Stephen J. Lechert, Jr.
*Attorney, Agent, or Firm*—Finnegan, Henderson, Farabow, Garrett & Dunner

[57] ABSTRACT

A method of hot isostatically pressing a cast material by heating the material to an elevated temperature, exposing the material to a pressure below the pressure which will cause void closure in the material, subsequent to the material reaching the elevated temperature, applying a predetermined high pressure to the material, and subjecting the material to elevated temperature and pressure to densify the material without inducing significant recrystallization in the material.

10 Claims, No Drawings

METHOD FOR PREVENTING RECRYSTALLIZATION DURING HOT ISOSTATIC PRESSING

FIELD OF THE INVENTION

The present invention relates to the hot isostatic pressing of materials and, more particularly, to a method of preventing recrystallization during hot isostatic pressing of cast materials.

BACKGROUND OF THE INVENTION

Hot isostatic pressing is a well known means for achieving full density in powder metallurgy products. Hot isostatic pressing has also been used to close voids in cast materials to improve their mechanical properties. However, when cast materials, and particularly single crystal cast materials, are hot isostatically pressed using conventional time, temperature, and pressure cycles (wherein the cast material is pressurized and then heated), the deformation associated with void closure induces significant recrystallization in the cast material.

In a single crystal, cast material such as a turbine blade, recrystallization cannot be tolerated in the blade because the creation of grain boundaries deleteriously effects the properties of the blade so that the blade cannot withstand the severe operating environment to which it is exposed. Consequently, a method of hot isostatically pressing a material, and particularly a single crystal cast material, which does not induce significant recrystallization in the material would be desirable.

Accordingly, it is an object of the invention to provide a method of hot isostatically pressing a cast material which does not induce significant recrystallization in the material.

Another objective of the invention is to provide a method of hot isostatically pressing a single crystal cast material which does not induce significant recrystallization in the single crystal.

Additional objects and advantaqes will be set forth in part in the description which follows, and in part, will be obvious from the description, or may be learned by practice of the invention.

SUMMARY OF THE INVENTION

To achieve the foregoing objects and in accordance with the present invention, as embodied and broadly described herein, the method of hot isostatically pressing a cast material of the present invention includes the steps of heating the material to an elevated temperature, exposing the material to a pressure below the pressure which will cause void closure in the material, subsequent to the material reaching the elevated temperature, applying a predetermined pressure to the material, the predetermined pressure being sufficiently high to close voids in the material, and subjecting the material to elevated temperature and high pressure to densify the material without inducinq significant recrystallization in the material.

Preferably, the method of the present invention further includes, prior to the step of applying a predetermined high pressure to the material, the step of holding the material at the elevated temperature for a period of time. More preferably, the material is held at the elevated temperature for a period of time sufficient to achieve a substantially uniform temperature throughout the material.

Still more preferably, the step of applying a predetermined high pressure to the material includes the step of increasing the pressure applied to the material at a rate which does not induce significant recrystallization a a result of deformation associated with closure of voids in the material.

DESCRIPTION OF THE PREFERRED EMBODIMENTS

Reference will now be made in detail to the present preferred embodiments of the invention.

In accordance with the invention, the method of hot isostatically pressing a cast material includes the steps of heating the material to an elevated temperature, exposing the material to a pressure below the pressure which will cause void closure in the material, subsequent to the material reaching the elevated temperature, applying a predetermined pressure sufficient to close voids in the material, and subjecting the material to an elevated temperature and a high pressure to densify the material without inducing significant recrystallization in the material.

The method of the present invention may be used to hot isostatically press both polycrystalline and single crystal cast materials. The method is particularly applicable to the hot isostatic pressing of single crystal, cast turbine blades. Those skilled in the art can readily form both polycrystalline and single crystal castings using conventional casting techniques. In addition, spray-deposited materials, which may be formed by vacuum plasma spray deposition, can be hot isostatically pressed without inducing significant recrystallization in the spray-deposited material in accordance with the invention. The method of the present invention has special utility in the attachment of such spray-deposited materials to conventionally cast materials to form composite assemblies.

In terms of the invention, such spray-deposited materials are considered to be cast materials.

In accordance with the invention, the cast material is heated to an elevated temperature. The elevated temperature must be sufficiently hiqh so that when pressure is applied the combination will deform the cast material so that the voids in the cast material can be closed. For a given material, those skilled in the art can readily determine a suitable temperature for hot isostatic pressing. In the case of cast materials formed of nickel-based superalloys, hot isostatic pressing is generally carried out at temperatures in the range of from 50° F. above to 50° F. below the gamma prime solvus temperature of the nickel-based superalloy cast material.

During heating of the cast material to the predetermined elevated temperature, the cast material is exposed to a pressure below the pressure which will cause void closure in the cast material. The pressure applied to the cast material is provided by a gaseous atmosphere. Thus, the cast material being hot isostatically pressed is located in a suitable pressure vessel such as an autoclave.

As in conventional hot isostatic pressing cycles, the pressure vessel is pre-filled with an amount of gas prior to the onset of heating of the cast material. Alternatively, the heating of the cast material may be initiated when near vacuum conditions exist in the pressure vessel. As the temperature in the pressure vessel increases, the pressure of the gas in the pressure vessel increases which results in a greater pressure being applied to the cast material.

In accordance with the invention, during heating of the cast material to the predetermined elevated temperature, the pressure which the cast material is exposed to is maintained below the pressure which will cause void closure in the cast material. Preferably, this is done by venting pressure from the pressure vessel.

Once the cast material is heated to the predetermined elevated temperature, it is desirable to hold the cast material at the elevated temperature for a period of time. Preferably, the cast material is held at the elevated temperature for a period of time sufficient to achieve a substantially uniform temperature throughout the cast material.

In accordance with the invention, subsequent to the cast material reaching the elevated temperature, a predetermined high pressure is applied to the cast material. The predetermined high pressure must be sufficient to close voids and densify the cast material at the particular elevated temperature used in hot isostatically pressing the cast material. Those skilled in the art will recognize that the pressure-temperature values are interdependent. For a given cast material, the same pressure will achieve more rapid deformation associated with void closure at higher temperatures. At lower temperatures, increased pressure is required.

In accordance with the invention, the predetermined high pressure is applied to the cast material by increasing the pressure such that the rate of pressurization does not induce significant recrystallization as a result of deformation associated with closure of voids in the cast material. When the predetermined high pressure has been reached, the cast material is then subjected to both the elevated temperature and the high pressure to densify the cast material without inducing significant recrystallization in the cast material.

In connection with the description of the invention, the term "significant recrystallization" is defined as recrystallization sufficient to degrade the properties of the cast material.

The principles of the present invention described broadly above will be described in detail with reference to a specific example. Monoloy 454 was used to cast single crystal turbine blades. Monoloy 454 typically includes about 12 w/o Ta, about 10 w/o Cr, about 5 w/o Co, about 5 w/o Al, about 4 w/o W, about 1.5 w/o Ti, up to about 0.02 w/o C, up to about 0.007 w/o Zr, and the balance nickel. When single crystal turbine blades cast from Monoloy 454 were hot isostatically pressed using a conventional time, temperature, and pressure cycle, significant recrystallization occurred in the cast material.

Subsequently, the single crystal turbine blades cast from Monoloy 454 were hot isostatically pressed in accordance with the method of the present invention. The single crystal turbine blades were pressurized in an autoclave to approximately 5000 psi and heated to a hot isostatic pressing temperature of about 2350° F. During heating of the single crystal blades to the elevated temperature, the pressure to which the blades were exposed was maintained at approximately 5000 psi by venting off the excess pressure which built up in the autoclave during heating.

After reaching 2350° F., the blades were held at that temperature and a pressure of approximately 5000 psi for a period of about one to two hours to allow a substantially uniform temperature throughout the blades to be achieved. Subsequently, pressure was applied to the blades at a rate of about 60 psi to about 80 psi a minute until a pressure of approximately 15,000 psi was reached. The blades were held at about 2350° F. and approximately 15,000 psi for about four hours. Examination of the thus-formed blades revealed that they were sufficiently densified and that no siqnificant recrystallization had occurred in the blades.

It will be apparent to those skilled in the art that various modifications and variations can be made in the method of hot isostatically pressing a cast material of the present invention without departing from the scope or spirit of the invention. The present invention has been disclosed in terms of preferred embodiments. The invention is not limited thereto and is defined by the appended claims and their equivalents.

What is claimed is:

1. A method of hot isostatically pressing a cast material, said method comprising the steps of:

heating said material to an elevated temperature;

exposing said material to a pressure below the pressure which will cause void closure in said material;

subsequent to said material reaching said elevated temperature, applying a predetermined pressure to said material, said predetermined pressure being sufficiently high to close voids in said material; and subjecting said material to elevated temperature and high pressure to densify said material without inducing significant recrystallization in said material.

2. The method of claim 1, wherein the step of exposing said material to a pressure below the pressure which will cause void closure in said material includes the step of:

venting the pressure from a pressure vessel during heating of said material.

3. The method of claim 1, wherein the step of applying a predetermined pressure to said material includes the step of:

increasing the pressure applied to said material at a rate which does not induce significant recrystallization as a result of deformation associated with closure of voids in said material.

4. The method of claim 1, wherein prior to said step of applying a predetermined pressure to said material, said method further comprises the step of:

holding said material at said elevated temperature for a period of time.

5. The method of claim 4, wherein said material is held at said elevated temperature for a period of time sufficient to achieve a substantially uniform temperature throughout said material.

6. A method of hot isostatically pressing a single crystal cast material, said method comprising the steps of:

heating said material to an elevated temperature;

exposing said material to a pressure below the pressure which will cause void closure in said material;

subsequent to said material reaching said elevated temperature, applying a predetermined pressure to said material, said predetermined pressure being sufficiently high to close voids in said material; and subjecting said material to elevated temperature and high pressure to densify said material without inducing significant recrystallization in said material.

7. The method of claim 6, wherein the step of exposing said material to a pressure below the pressure which will cause void closure in said material includes the step of:

venting the pressure from a pressure vessel during heating of said material.

8. The method of claim 6, wherein the step of applying a predetermined pressure to said material includes the step of:

increasing the pressure applied to said material at a rate which does not induce significant recrystallization as a result of deformation associated with closure of voids in said material.

9. The method of claim 6, wherein prior to said step of applyinq a predetermined pressure to said material, said method further comprises the step of:

holding said material at said elevated temperature for a period of time.

10. The method of claim 9, wherein said material is held at said elevated temperature for a period of time sufficient to achieve a substantially uniform temperature throughout said material.

* * * * *